US005857615A

United States Patent [19]

Rose

[11] Patent Number: 5,857,615

[45] Date of Patent: Jan. 12, 1999

[54] CONTAINER HOLDER

[75] Inventor: Michael J. Rose, Colton, Oreg.

[73] Assignee: New Dimensions Folding Carton, Inc., Colton, Oreg.

[21] Appl. No.: 782,607

[22] Filed: Jan. 13, 1997

[51] Int. Cl.[6] ..... B65D 5/62

[52] U.S. Cl. ..... 229/403; 220/737; 220/739; 428/162

[58] Field of Search ..... 229/4.5, 104, 400, 229/403, 939; 220/737, 738, 739, 903; 217/3 FC; 428/34.2, 162, 172

[56] References Cited

U.S. PATENT DOCUMENTS

| | | | |
|---|---|---|---|
| 1,632,347 | 6/1927 | Pipkin . | |
| 1,771,765 | 7/1930 | Benson . | |
| 1,866,805 | 7/1932 | Haywood . | |
| 1,975,510 | 10/1934 | Hiatt | 217/3 FC |
| 2,025,201 | 12/1935 | Graham | 217/3 FC |
| 2,028,566 | 1/1936 | Seipel et al. . | |
| 2,140,932 | 12/1938 | Avery | 229/104 |
| 2,154,985 | 4/1939 | Lower | 217/3 FC |
| 2,266,828 | 12/1941 | Sykes . | |
| 2,591,578 | 4/1952 | McNealy et al. . | |
| 2,617,549 | 11/1952 | Egger . | |
| 2,661,889 | 12/1953 | Phinney . | |
| 2,675,954 | 4/1954 | Vogel . | |
| 2,853,222 | 9/1958 | Gallagher . | |
| 2,979,301 | 4/1961 | Reveal . | |
| 3,049,277 | 8/1962 | Shappell . | |
| 3,123,273 | 3/1964 | Miller . | |
| 3,157,335 | 11/1964 | Maier . | |
| 3,908,523 | 9/1975 | Shikaya . | |
| 4,685,583 | 8/1987 | Noon . | |
| 5,092,485 | 3/1992 | Lee . | |
| 5,145,107 | 9/1992 | Silver et al. . | |
| 5,205,473 | 4/1993 | Coffin, Sr. . | |
| 5,209,367 | 5/1993 | Van Musscher et al. | 220/737 |
| 5,222,656 | 6/1993 | Carlson . | |
| 5,425,497 | 6/1995 | Sorensen . | |
| 5,454,484 | 10/1995 | Chelossi . | |
| 5,547,124 | 8/1996 | Mueller | 229/403 |

*Primary Examiner*—Gary E. Elkins
*Attorney, Agent, or Firm*—Ingrid M. McTaggart

[57] ABSTRACT

The present invention provides an improved container holder having a unique shape that facilitates efficient manufacturing of the holder and printing of advertising material at a predetermined location on the holder. The container holder comprises an elongate body delimited by top and bottom edges and first and second end edges. The top and bottom edges define straight lines that are parallel to each other. The body further comprises a first tab positioned at the first end edge of the body, and a second tab positioned interiorly of the body, and generally adjacent to the first tab. The tabs are positioned at an acute angle with respect to one of the top and bottom edges, and extend away from each other in opposite directions. The body further comprises a first slot positioned adjacent the second end edge, and a second slot positioned generally adjacent the first slot. The first and second slots are positioned so as to receive the corresponding first and second tabs, the slots being positioned at an acute angle with respect to one of the top and bottom edges. The body further comprises an outer surface having a texture embossed thereon so as to increase the grippability and insulating properties of the container holder.

12 Claims, 3 Drawing Sheets

CONTAINER HOLDER

The present invention relates to an improved container holder, and more particularly, to an improved container holder having a shape that facilitates efficient manufacturing of the container holder, predictable placement of printing thereon and ease of stacking the container holder.

BACKGROUND OF THE INVENTION

Container holders are used to reduce the rate of heat transfer between a container and a hand gripping the container holder. Container holders also may be used to increase the grippability of the container. Additionally, container holders may be used to advertise a product by including advertising material printed on an outer surface of the container holder.

Conventional container holders typically are manufactured with arcuate top and bottom edges such that when the holder is fastened in an assembled configuration, the holder forms a tapered sleeve that may be positioned about a tapered container. Such arcuate top and bottom edges lead to inefficient manufacturing in that a large portion of a sheet of material, from which the holders are cut, remains unused and numerous cuts must be made in the sheet to form the holder. In addition, the arcuate top and bottom edges lead to nonuniform spacing of the container holders within the sheet of material such that advertising material printed on the container holders is not predictably centered thereon.

Conventional container holders may be permanently fastened in the assembled configuration by adhesive placed along overlapping end edges. These permanently assembled container holders are expensive to ship and store in that they require a relatively large volume of space. Releasably fastenable container holders may be assembled by interlocking mating webs, the webs created by oppositely extending cuts that sever the top and bottom edges, respectively, of the holder. The mating web configuration provides a "tear drop" shaped cross section when the holder is assembled and provides outwardly extending tabs that may become torn and that may snag other holders upon stacking. Accordingly, to stack such a holder, the holder must be pressed into a shape having a circular cross section while simultaneously preventing tearing or snagging of the webs.

SUMMARY OF THE INVENTION

Accordingly, an object of the present invention is to provide an improved container holder that has a unique shape.

Another object of the present invention is to provide an improved container holder that facilitates printing of advertising material at a predetermined location on the holder.

Yet another object of the present invention is to provide an improved container holder that has a shape which facilitates efficient use of materials.

Still another object of the present invention is to provide an improved container holder that may be securely fastened in a circular configuration.

A further object of the present invention is to provide an improved container holder that may be releasably fastened and that, in an assembled configuration, is easily stacked and which does not provide outwardly extending webs that may become torn or snagged.

Accordingly, the present invention provides an improved container holder that has a unique shape and that facilitates printing of advertising material at a predetermined location on the holder. Additionally, the present invention provides an improved container holder that has a shape which facilitates efficient use of materials, that may be securely fastened in a circular configuration, that is easily stacked, and that does not include outwardly extending webs.

In a preferred embodiment, the improved container holder is cut from a discrete sheet of material and comprises an elongate body delimited by top and bottom edges and first and second end edges. The top and bottom edges preferably define straight lines that are parallel to each other. The body further comprises a first tab positioned at the first end edge of the body, and a second tab, positioned interiorly of the body, and generally adjacent the first tab. In the preferred embodiment, the tabs have an elongate direction that is positioned at an acute angle with respect to an elongate direction of one of the top and bottom edges, and extend away from each other in opposite directions. The body further comprises a first slot positioned adjacent the second end edge, and a second slot positioned generally adjacent the first slot. In the preferred embodiment, the first and second slots are positioned so as to receive the corresponding first and second tabs, the slots having an elongate direction that is positioned at an acute angle with respect to an elongate direction of one of the top and bottom edges. Additionally, in the preferred embodiment, the body includes an outer surface having a texture embossed thereon so as to increase the grippability and insulating properties of the container holder. The outer surface may further comprise advertising material printed thereon.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
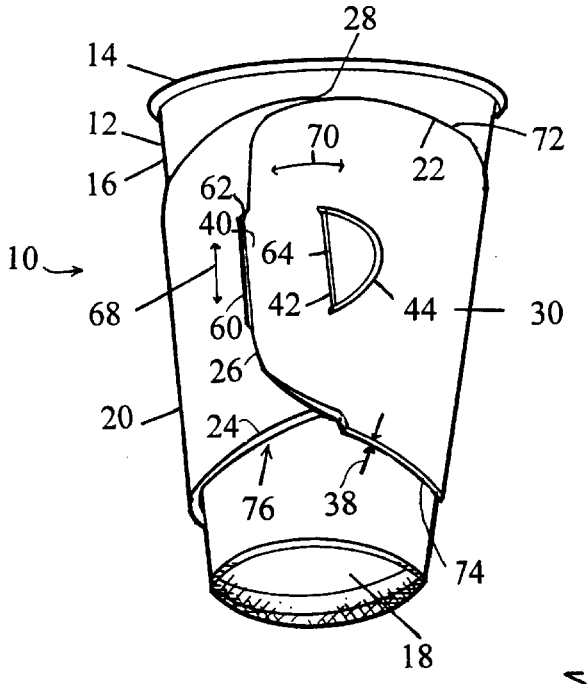
FIG. 1 is an isometric side and bottom view of the container holder of the present invention mounted on a container.

Referring to FIG. 1, which is an isometric side and bottom view of the container holder of the present invention mounted on a container, the present invention comprises a container holder 10 frictionally secured to a container 12. Container 12 preferably is a cup including an open top end 14, a tapered side wall 16, and a closed bottom end 18. Container 12 may be manufactured of plastic, foam or paper, and may be adapted to hold ice cream, soup or beverages such as iced soda or hot coffee. The container holder preferably is manufactured of paper, such as cardboard, so as to render the holder reusable and recyclable.

Figure 2:
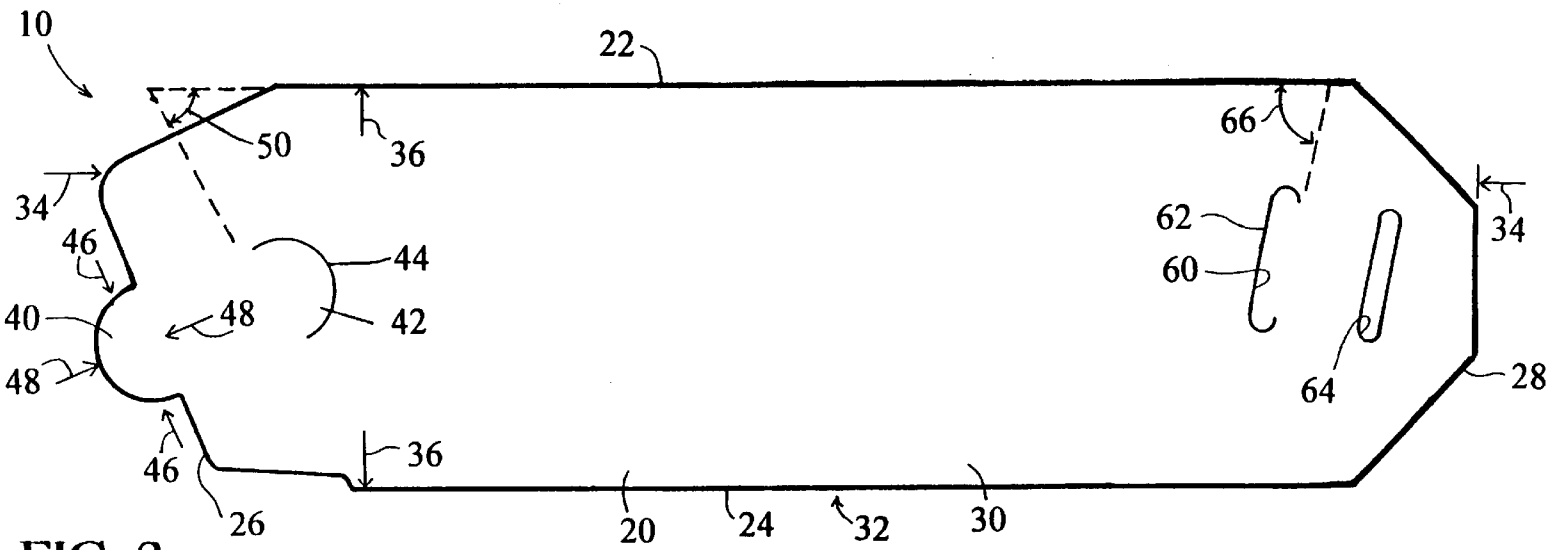
FIG. 2 is an elevational side view of the container holder in an unassembled configuration.

Referring now to FIG. 2, which is an elevational side view of the container holder in an unassembled configuration, container holder 10 includes an elongate body 20 delimited by a top edge 22, a bottom edge 24, a first end edge 26 and a second end edge 28. First end edge 26 preferably is curved whereas second end edge 28 is bevel shaped. Edges 22 and 24 are generally straight, i.e., the edges are straight along their lengths but taper into end edges 26 and 28. Edges 22 and 24 preferably are parallel to each other to facilitate ease of manufacturing as will be described below.

Elongate body 20 further comprises a generally planar outer surface 30 and a generally planar inner surface 32 for contacting the container. In the preferred embodiment, elongate body 20 has a length 34 of approximately 11 ½ inches (approximately 29 centimeters), a height 36 of approximately 3 ¼ inches (approximately 8 centimeters) and a thickness 38 (FIG. 1) of approximately 1/16inch (approximately 0.1 centimeter).

Body 20 further comprises a fastening device including a first tab 40 extending outwardly from the body along first end edge 26. A second tab 42 is created within body 20 by making a cut 44 through thickness 38 of the container holder. In the preferred embodiment, first and second tabs 40 and 42 are semicircular in shape, are approximately 1 inch (approximately 3 centimeters) measured along a length 46, and are approximately ½ inch (approximately 1.5 centimeters) measured along a depth 48. In a preferred embodiment, first end edge 26, and the elongate directions of tabs 40 and 42 as measured along length 46 of the tabs (the elongate directions represented by the dashed line that is aligned with tab 42), are positioned at an acute angle 50 with respect to an elongate direction of top edge 22(as shown by the dashed line extending from top edge 22). In the preferred embodiment, angle 50 is approximately 60°. This angle may be varied to accommodate a variety of tapers of side wall 16 of container 12.

Still referring to FIG. 2, body 20 further comprises a first slot 60 created by making a cut 62 within body 20 through thickness 38. In the illustrated embodiment, cut 62 is an elongate "C" shape. The elongate body preferably further comprises a second slot 64 generally aligned with the first slot and positioned between the first slot and second end edge 28, the second slot comprising an elongate aperture in body 20. Slots 60 and 64 may be positioned with their elongate directions (represented by the dashed line that is aligned with slot 60) at an acute angle 66 with respect to an elongate direction of top edge 22. In the preferred embodiment, slots 60 and 64 have a length slightly longer than the length of tabs 40 and 42, respectively, and angle 66 is approximately 80°. This angle may be varied to accommodate a variety of tapered containers. In other embodiments, the fastening device may comprise snaps, mateable plush and pile material or adhesive. Tabs and slots are preferable as the fastening device, however, because the tabs and slots can be manufactured integral with the container holder body.

Referring again to FIG. 1, assembly of container holder 10 will be described. To secure the container holder on a container, elongate body 20 is pulled into a circular configuration such that first end edge 26 generally overlies second end edge 28. Second tab 42 is then pushed downwardly toward second end edge 28 and is inserted into second slot 64. In this configuration, the container may be placed within the holder, the width of the container retaining tab 42 within slot 64.

To further secure the holder in a circular configuration, first tab 40 is bent downwardly and inserted into first slot 60. In this configuration, first end edge 26 is prevented from moving vertically in a direction indicated by arrow 68 with respect to second end edge 28 due to the positioning of tabs 40 and 42 within slots 60 and 64, respectively. Moreover, first end edge 26 is prevented from moving horizontally in a direction indicated by arrow 70 by the oppositely extending configuration of tabs 40 and 42, which are secured within slots 60 and 64, respectively. In this assembled configuration, container holder 10 is securely, releasably fastened in a circular configuration having an upper opening 72 and a lower opening 74 that define an open interior 76 for receiving container 12 therein. Moreover, due to the angled configuration of the tabs and the mating slots, container holder 10 in the assembled configuration defines a tapered sleeve preferably having a taper matching that of tapered side wall 16 of container 12.

In this assembled configuration, tabs 40 and 42 are positioned within open interior 76 thereby providing for comfortable gripping by a hand of outer surface 30. Additionally, the flexible yet somewhat resilient properties of the cardboard holder, in combination with the orientation of slots 60 and 64, tends to provide a circular cross section of the assembled holder and tends to position tabs 40 and 42 flush against the inner surface 32 of open interior 76. The circular cross section and the flush positioning of the tabs provides an assembled container that is readily stackable without manual flattening of the tabs or shaping of the holder. Moreover, such interior, flush positioning of the tabs lessens the chance of damage to the tabs such as tearing or snagging.

Figure 3:
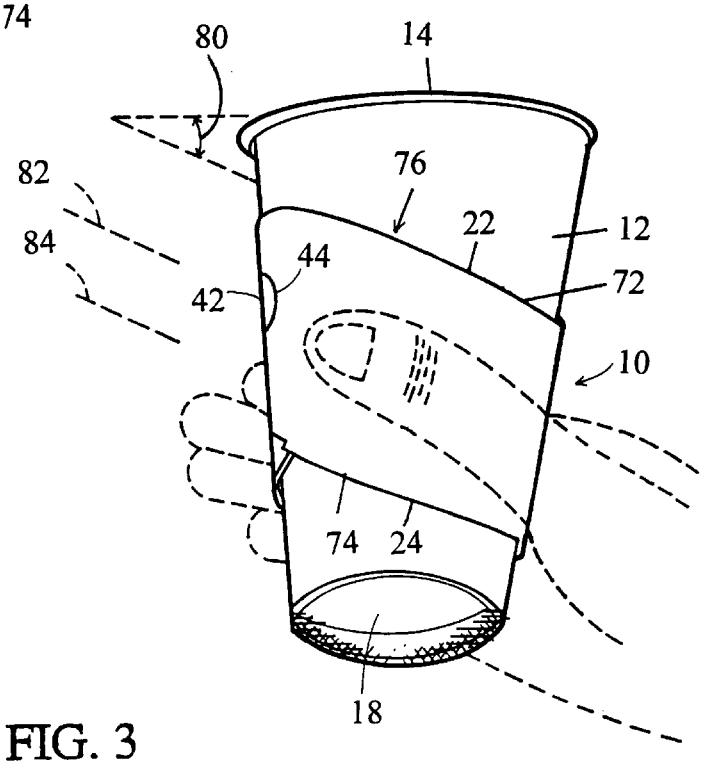
FIG. 3 is an isometric side and bottom view of the container holder of the present invention mounted on a container and rotated 90° from the view shown in FIG. 1.

Referring to FIG. 3, which is an isometric side and bottom view of the container holder of the present invention mounted on a container and rotated 90° from the view shown in FIG. 1, container holder 10 in an assembled configuration is shown to be ergonomically shaped so as to facilitate gripping by, and insulation of, a hand grasping the container holder. More specifically, top edge 22 of container holder 10 defines an acute angle 80 with respect to open top end 14 of container 12, angle 80 being approximately 10°. Bottom edge 24 preferably is approximately parallel to top edge 22 in the assembled configuration.

When container holder 10 is grasped, with the thumb and the index finger surrounding the holder and the palm of the hand being positioned opposite from the tabs and the slots, the thumb and the index finger (indicated by dashed lines), in an ergonomically comfortable position, define lines 82 and 84, respectively. Lines 82 and 84 generally are parallel to container holder top edge 22. Accordingly, container holder 10, having straight top and bottom edges 22 and 24, defines an ergonomically comfortable container holder that spaces a user's thumb and index finger away from container 12 when the user's hand is in an ergonomically comfortable position. Moreover, in this position, the user's thumb and fingers do not overlie the end edges or the slots and tabs of body 20, thereby providing a comfortable gripping surface.

Figure 4:
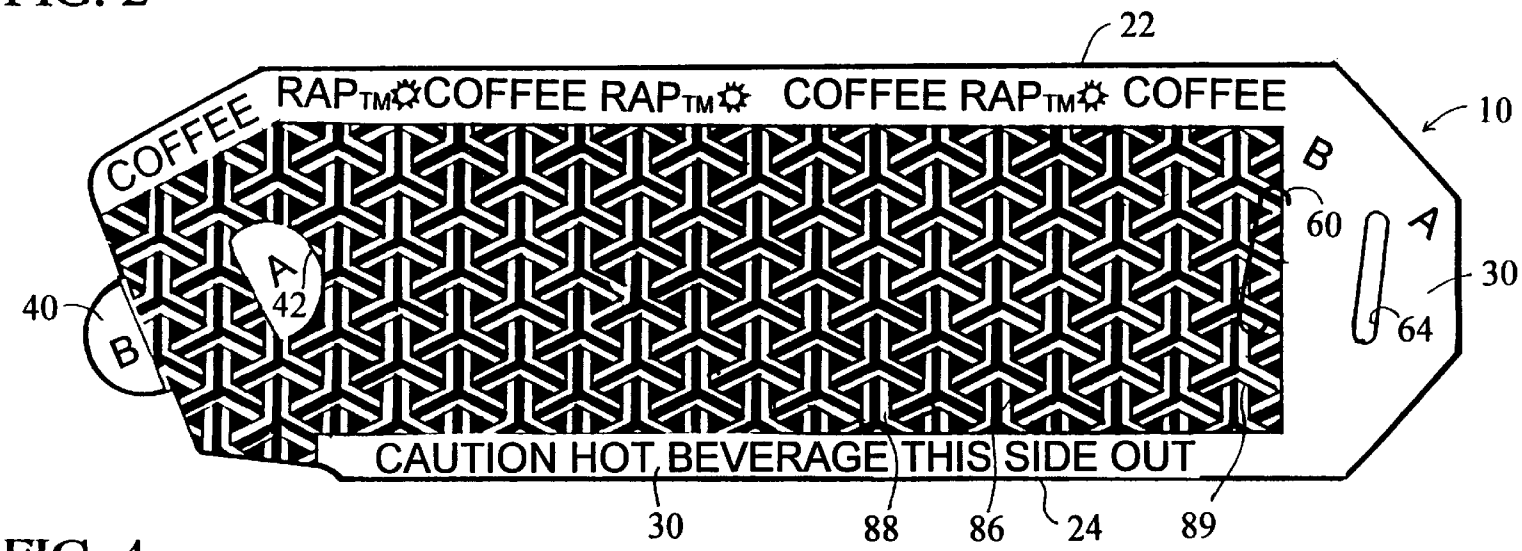
FIG. 4 is an elevational side view of the preferred embodiment of the container holder in an unassembled configuration and showing the embossed texture of the outer surface.

Referring now to FIG. 4, which is an elevational side view of the preferred embodiment of the container holder in an unassembled configuration and showing the debossed texture of the outer surface, outer surface 30 of container holder 10 preferably comprises a "wicker" type debossed texture having a plurality of triangular shaped depressions 86 and a plurality of inverted "Y" shaped protrusions 88 which form a regular pattern across the outer surface so as to enhance the frictional grippability of the holder. Specifically, the inverted "Y" shaped protrusions form downwardly extending, peaked shaped shoulders 89 that provide for contact with the upper portion of the thumb and the index finger. Moreover, triangular shaped depressions 86 and inverted "Y" shaped protrusions 88 space a user's hand away from container 12 such that the holder reduces the rate of heat transfer between the container and the hand gripping the holder.

Still referring to FIG. 4, second tab 42 and second slot 64 include the debossed designation "A" positioned on or adjacent thereto. Similarly, first tab 40 and first slot 60 have the debossed designation "B" positioned on or adjacent thereto. Moreover, container holder 10 includes on outer surface 30 the designation "CAUTION HOT BEVERAGE THIS SIDE OUT". Accordingly, upon assembly of the container holder, the user will bend the holder into a circular configuration, insert tab "A" into slot "A" and then insert tab "B" into slot "B". In this configuration, the "wicker" debossed texture will face outwardly from the enclosed container so as to provide an easily grippable surface and so as to provide insulation of the user's hand.

Figure 5:
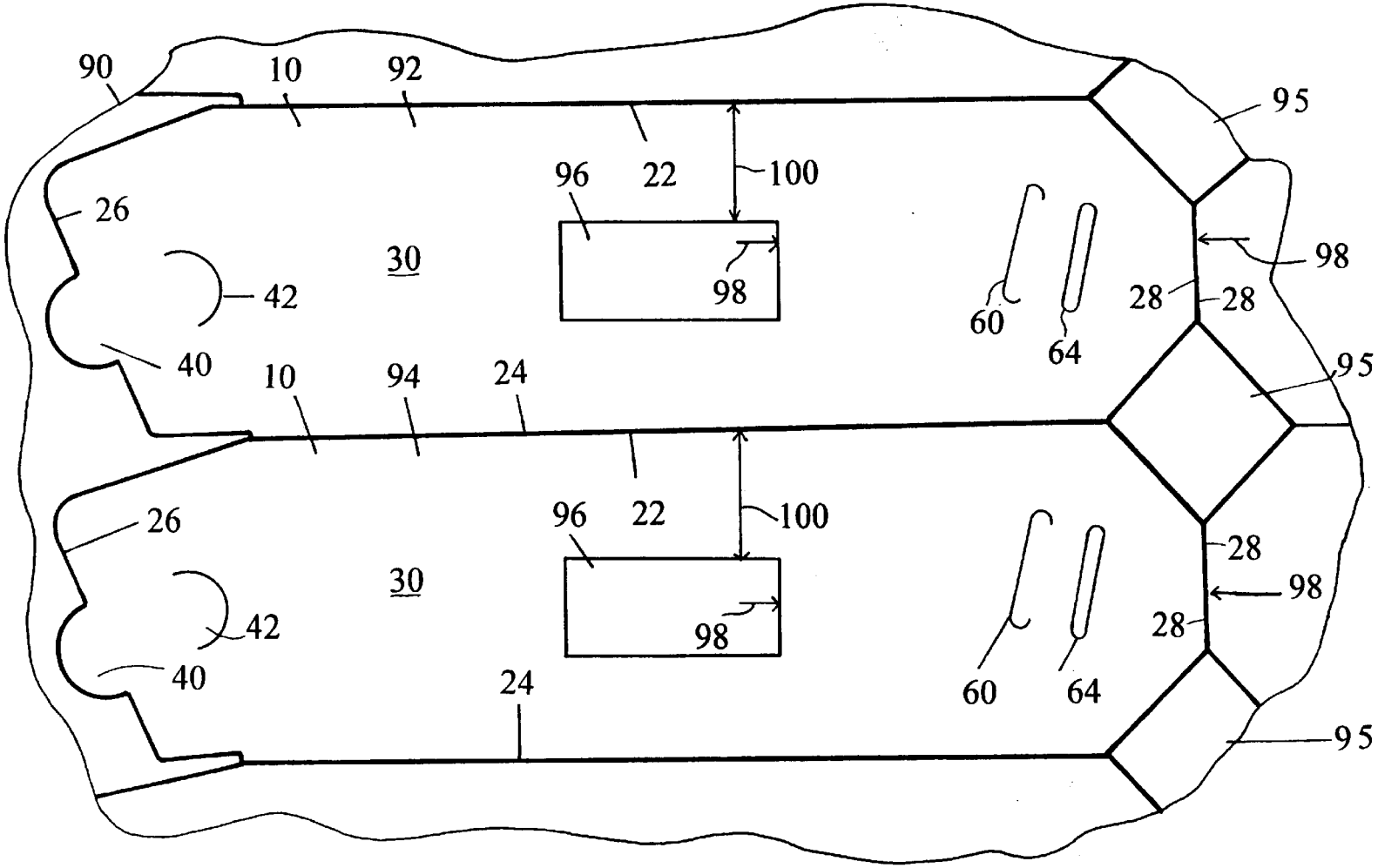
FIG. 5 is an elevational side view of a portion of a sheet of material showing the location of multiple container holders prior to cutting of the holders from the sheet.

Referring now to FIG. 5, which is an elevational side view of a portion of a sheet of material showing the location of multiple container holders prior to cutting of the holders from the sheet, the method of manufacturing container holder 10 will be described. Holder 10 comprises top edge 22 and bottom edge 24 that in the preferred embodiment define straight parallel lines. Accordingly, only a single cut is required in a sheet of material 90 to define the bottom edge 24 of a first container holder 92 and the top edge 22 of an adjacent second container holder 94. Moreover, due to the straight parallel lines defined by the top and bottom edges, a relatively small amount of material 95 of sheet 90 is wasted. In addition, due to the straight lines defined by the top and bottom edges, second side edges 28 of consecutive container holders 92 and 94 are easily aligned so as to facilitate printing of a pattern 96 at a predetermined position on the outer surface 30 of the holders. Specifically, pattern 96 may be positioned a distance 98 from second end edge 28, and a distance 100 from top edge 22, for each of the consecutive holders cut from sheet 90.

Accordingly, there is described a container holder that is easy to manufacture, provides for efficient use of materials 90 and facilitates reliable placement of a pattern 96 on the outer surface of the container holder.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A sleeve for encircling a container having a tapered side wall to reduce the rate of heat transfer between the container and a hand gripping the sleeve, comprising:

an elongate body having a periphery including an edge portion that defines a straight line when said elongate body is in an unassembled configuration;

a slot located interiorly of said periphery;

a tab located interiorly of said periphery and being sized to fit within said slot so as to releasably secure the body in a generally circular assembled configuration wherein said edge portion defines an opening for receiving said container therein; and wherein said elongate body further comprises an outer surface including a plurality of triangular shaped depressions which form a regular patttern across said outer surface so as to enhance the frictional grippability of said sleeve.

2. A holder for a tapered cup comprising:

a band having a straight edge portion when in an unassembled configuration, and wherein said edge portion in a generally circular assembled configuration defines an opening for receiving a cup therein;

a tab interiorly positioned within said band;

a slot positioned within said band and having an elongate direction at an acute angle with respect to an elongate direction of said straight edge portion, said slot and said tab capable of mating securement so as to fasten the band in the generally circular assembled configuration; and wherein said band further comprises an outer surface including a plurality of triangular shaped depressions which from a regular pattern across said outer surface so as to enhance the frictional grippability of said holder.

3. A cup and holder combination, comprising:

a cup having a tapered side wall; and a holder having an elongate body that encircles the side wall of the cup, the body including a periphery having a top edge portion that defines a straight line when in an unassembled configuration and fastening means positioned interiorly of said periphery so as to secure the holder in a generally continuous tapered band configuration about said cup.

4. A cup and holder combination according to claim 3 wherein said periphery further comprises a bottom edge portion and wherein said top and bottom edge portions are parallel to each other.

5. A cup and holder combination according to claim 3 wherein said fastening means comprises a slot and a mating tab.

6. A cup and holder combination according to claim 5 wherein said fastening means further comprises another slot and another mating tab, said tabs extending generally opposite to each other.

7. A cup and holder combination according to claim 3 wherein said fastening means defines an elongate direction that is positioned at an acute angle with respect to an elongate direction of said top edge portion.

8. A cup and holder combination according to claim 3 wherein said body further comprises an outer surface including a plurality of triangular shaped depressions which form a regular pattern across said outer surface so as to enhance the frictional grippability of said holder.

9. A cup and holder combination according to claim 3 wherein said body further comprises an outer surface including a plurality of protrusions which form a regular pattern across said outer surface so as to enhance the frictional grippability of said holder.

10. A friction enhancing container holder, comprising:

an elongate band having an outer surface that defines top and bottom edges and including fastening means positioned interiorly of said top and bottom edges, said outer surface including a plurality of inverted "Y" shaped protrusions which form a regular pattern across said outer surface so as to enhance the frictional grippability of said holder.

11. A friction enhancing container holder according to claim 10 wherein said top and bottom edges each define a straight line.

12. A friction enhancing container holder according to claim 10 wherein said fastening means comprises a slot and a mating tab and wherein an elongate direction of said slot and an elongate direction of said mating tab are positioned at an acute angle with respect to one of said top and bottom edges.

* * * * *